US008805212B2

(12) United States Patent
Mimura

(10) Patent No.: US 8,805,212 B2
(45) Date of Patent: Aug. 12, 2014

(54) IMAGE FORMING APPARATUS, FAILURE INFORMATION NOTIFICATION SYSTEM AND FAILURE INFORMATION NOTIFICATION METHOD

(75) Inventor: Toshifumi Mimura, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 124 days.

(21) Appl. No.: 13/366,464

(22) Filed: Feb. 6, 2012

(65) Prior Publication Data

US 2012/0243884 A1 Sep. 27, 2012

Related U.S. Application Data

(60) Provisional application No. 61/467,650, filed on Mar. 25, 2011.

(30) Foreign Application Priority Data

Jan. 13, 2012 (JP) ..... 2012-004692

(51) Int. Cl.
*G03G 15/00* (2006.01)

(52) U.S. Cl.
USPC ..... 399/24; 399/12

(58) Field of Classification Search
USPC ..... 399/10–13, 18, 24–27, 29
See application file for complete search history.

(56) References Cited

U.S. PATENT DOCUMENTS

| | | | | |
|---|---|---|---|---|
| 7,010,236 | B2 | 3/2006 | Shinkawa et al. | |
| 7,062,179 | B2 * | 6/2006 | Ikeno | 399/8 |
| 7,177,553 | B2 | 2/2007 | Ono | |
| 2005/0031367 | A1 * | 2/2005 | Fukaya | 399/85 |
| 2005/0220462 | A1 * | 10/2005 | Miyaji | 399/24 |
| 2012/0134686 | A1 * | 5/2012 | Jones et al. | 399/12 |

FOREIGN PATENT DOCUMENTS

| | | |
|---|---|---|
| CN | 1694004 | 11/2005 |
| JP | 2005-122658 | 5/2005 |
| JP | 2009-038702 | 2/2009 |
| JP | 2009-066951 | 4/2009 |

OTHER PUBLICATIONS

Okidata Corp., B930n Users Guide; Jan. 10, 2008.*

State Intellectual Property Office of the People's Republic of China Notification of the First Office Action for Chinese Patent Application No. 201210030524.6 Dated Aug. 2, 2013, 19 pgs.

* cited by examiner

*Primary Examiner* — Clayton E Laballe

*Assistant Examiner* — Victor Verbitsky

(74) *Attorney, Agent, or Firm* — Amin, Turocy & Watson, LLP

(57) ABSTRACT

According to one embodiment, an image forming apparatus includes: a storage medium which stores manufacture information to a consumable supply; a reading unit which reads information in the storage medium; a communication control unit which receives failure information of the consumable supply; a display unit which displays information; and a control unit which receives the failure information of the consumable supply by the communication control unit, then determines whether a consumable supply in use is equivalent to a failed consumable supply or not, and performs control to display the failure information on the display unit when the consumable supply is determined as equivalent to the failed consumable supply.

18 Claims, 7 Drawing Sheets

IMAGE FORMING APPARATUS, FAILURE INFORMATION NOTIFICATION SYSTEM AND FAILURE INFORMATION NOTIFICATION METHOD

CROSS-REFERENCE TO RELATED APPLICATIONS

This application is based upon and claims the benefit of priority from the prior U.S. Patent Application No. 61/467,650, filed on Mar. 25, 2011, the entire content all of which is incorporated herein by reference.

This application is also based upon and claims the benefit of priority from the prior Japanese Patent Applications No. 2012-4692, filed on Jan. 13, 2012, the entire contents all of which are incorporated herein by reference.

FIELD

Embodiments described herein relate generally to an image forming apparatus, a failure information notification system and a failure information notification method.

BACKGROUND

An image forming system is known which acquires management information about consumable supplies via an RFID device attached to consumable supplies of an image forming apparatus and then automatically replaces or orders the consumable supplies. However, if a failure is found in the same consumable supplies as those used in the image forming apparatus after shipment, there is a problem that whether the consumable supplies used in the image forming apparatus are equivalent to failed consumable supplies or not cannot be checked quickly.

DETAILED DESCRIPTION

Figure 1:
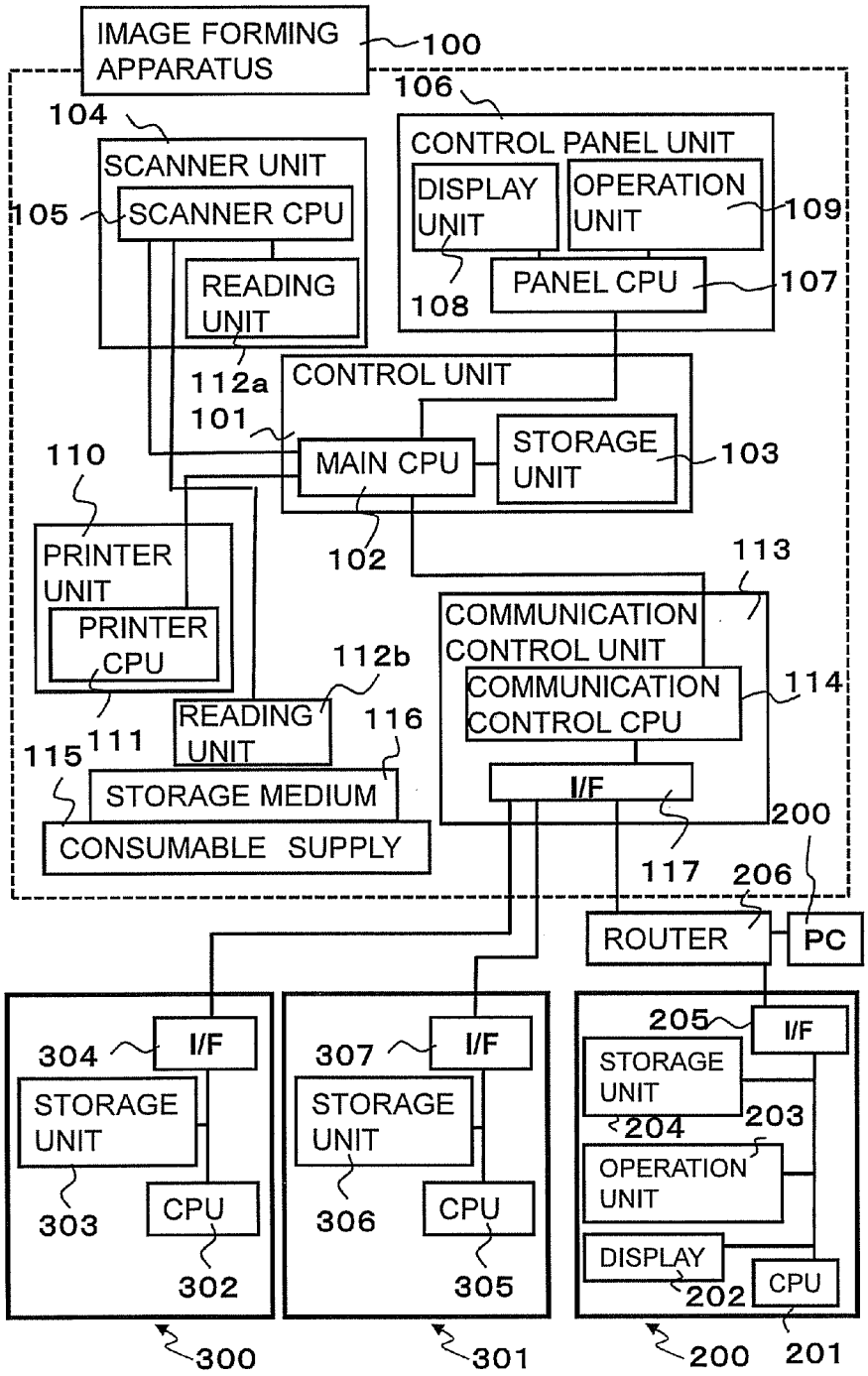
FIG. 1 is a block diagram showing a failure notification system according to a first embodiment.

In general, according to one embodiment, an image forming apparatus includes: a storage medium stores manufacture information to a consumable supply; a reading unit reads information in the storage medium; a communication control unit receives failure information of the consumable supply; a display unit displays information; and a control unit receives the failure information of the consumable supply by the communication control unit, then determines whether a consumable supply in use is equivalent to a failed consumable supply or not, and performs control to display the failure information on the display unit if the consumable supply is determined as equivalent to the failed consumable supply.

Embodiments will now be described in more detail with reference to the accompanying drawings. However, the same numerals are applied to the similar elements in the drawings, and therefore the detailed descriptions thereof are not repeated.

First Embodiment

An image forming apparatus according to a first embodiment receives failure information if a failure is found in a consumable supply after shipment, then determines whether recorded information in a storage medium of the consumable supply is equivalent to failure information or not, and notifies the user or maintenance company (maintenance man) if the recorded information is equivalent to failure information.

FIG. 1 is a block diagram showing a failure information notification system. The failure information notification system includes, for example, an image forming apparatus 100, plural PCs (personal computers) 200, a first server (for example, first electronic device) 300, and a second server (for example, second electronic device) 301.

The image forming apparatus 100 includes a control unit 101, a scanner unit 104, a control panel unit 106, a printer unit 110, a communication control unit 113, and a consumable supply 115 having a storage medium 116. The detailed hardware configuration of the image forming apparatus 100 will be separately described with reference to FIG. 2.

The control unit 101 controls overall operations of the image forming apparatus 100. The control unit 101 includes a main CPU 102 in charge of controlling the image forming apparatus 100, and a storage unit 103. The storage unit 103 is a memory, for example, a semiconductor memory, HDD (hard disk drive) or the like. The storage unit 103 stores a program for causing the main CPU 102 to operate.

The scanner unit 104 includes a scanner CPU 105, a reading unit 112*a* and a reading unit 112*b*. The scanner CPU 105 is in charge of controlling the scanner unit 104. The reading unit 112*a* reads an image of a document. The reading unit 112*b* reads the storage medium 116 provided on the consumable supply 115. If the storage medium 116 is a non-contact IC (integrated circuit) chip, the reading unit 112*b* is an IC chip reader.

The storage medium 116 is not limited to a non-contact IC chip but may be a barcode, two-dimensional code, or RFID (radio frequency identification) tag. If the storage medium 116 is a barcode, the reading unit 112*b* is a barcode reader. If the storage medium 116 is a two-dimensional code, the reading unit 112*b* is a two-dimensional code reader. If the storage medium 116 is an RFID tag, the reading unit 112*b* is an RFID reader.

The control panel unit 106 includes a panel CPU 107, a display unit 108, and an operation unit 109. The panel CPU 107 controls the control panel unit 106. The display unit 108 displays processing modes of the image forming apparatus 100. The processing modes include copy, scan, fax transmission and the like. The control unit 101 displays various settings such as the number of sheets to be printed and the sheet size on the display unit 108. The operation unit 109 can select a processing mode. The display unit may be a touch panel type or may also function as an operation unit. The operation unit 109 has various keys.

The printer unit 110 includes a printer CPU 111 in charge of controlling the printer unit 110. The communication control unit 113 transmits and receives failure information of the consumable supply 115. The communication control unit 113 includes a communication control CPU 114 in charge of controlling the communication control unit 113, and a communication interface (I/F) 117. The communication interface 117 connects to the first server 300 via a system bus and a communication interface 304 provided in the first server 300. Similarly, the communication interface 117 connects to the second server 301 via a system bus and a communication interface 307 provided in the second server 301. The communication control CPU 114 transmits failure information of a consumable supply to the second server 301. The communication control CPU 114 also connects to the plural PCs 200 via a router 206 and a communication interface 205 provided in each PC connected to this router 206.

The first server 300 includes a CPU 302, a storage unit 303 and a communication interface 304, and is a server of a consumable supply distributor or image forming apparatus distributor. When a failure is found in a consumable supply, the first server 300 transmits failure information of the consumable supply to the communication control unit 113 of the image forming apparatus 100 via the communication interface 304.

The second server 301 includes a CPU 305, a storage unit 306 and a communication interface 307, and is a server of a maintenance company. The second server 301 receives consumable supply replacement information from the communication control unit 114 of the image forming apparatus 100 via the communication interface 307.

The PC 200 includes a CPU 201, a display unit 202, an operation unit 203, a storage unit 204 and a communication interface 205.

The storage units 303 and 306 of the first and second servers and the storage unit 204 of the PC are memories, for example, semiconductor memories, HDDs (hard disk drives) or the like. The storage units 303, 306 and 204 store programs for causing the respective CPUs 302, 305 and 201 to operate.

Figure 2:
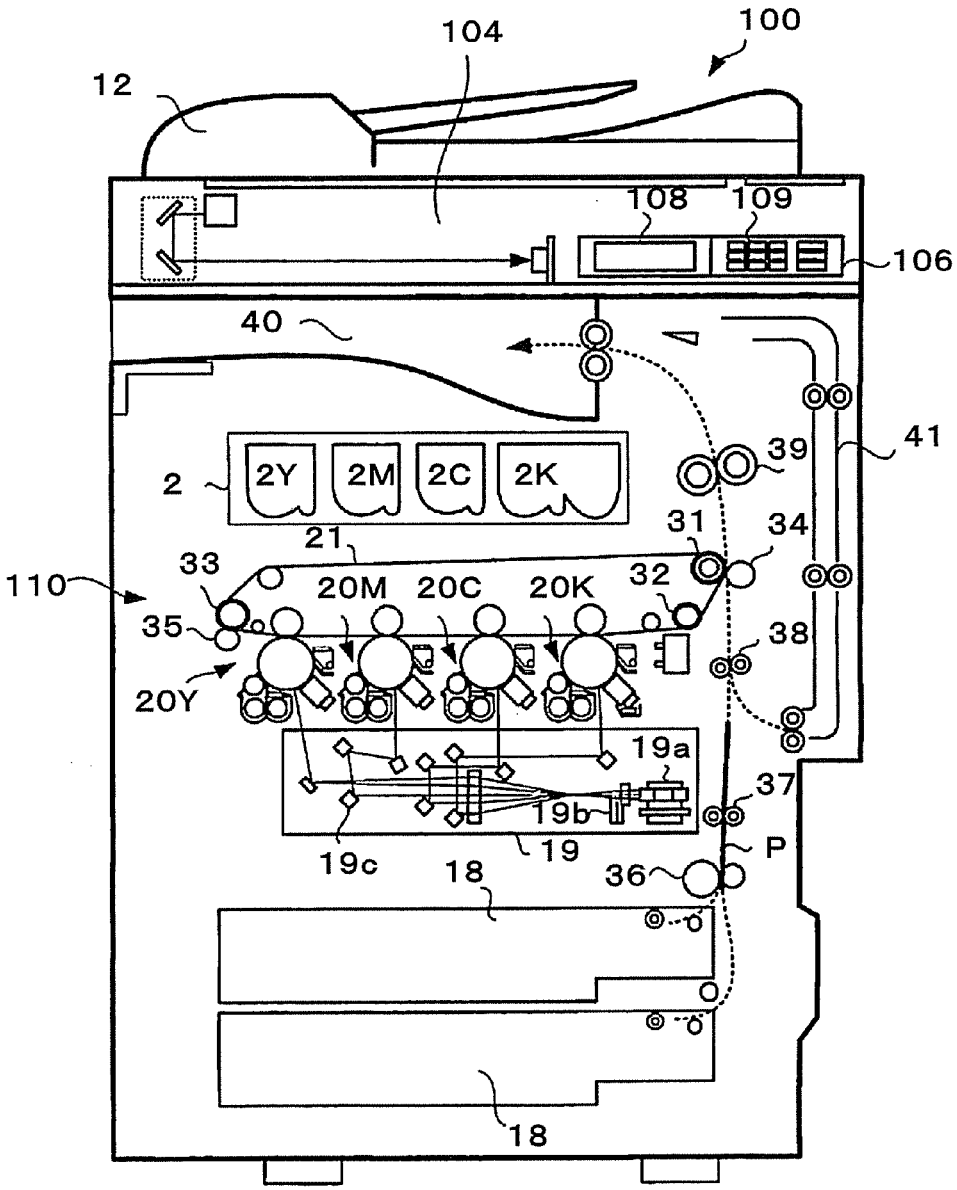
FIG. 2 is a view showing the configuration of an image forming apparatus according to the first embodiment.

FIG. 2 is a view of the configuration of the image forming apparatus according to the first embodiment. In FIG. 2, the image forming apparatus 100 is, for example, an MFP (multifunction peripheral), printer, copier or the like. In the following description, an MFP is described by way of example.

The MFP 100 includes an automatic document feeder (ADF) 12, the control panel unit 106, the scanner unit 104, the printer unit 110, a paper supply unit (paper supply cassette) 18, and a paper discharge unit 40.

The ADF 12 is provided on a document table in a manner that enables free opening and closing, and automatically feeds a document. The control panel unit 106 includes the operation unit 109 having various keys, and the touch panel-type display unit 108.

The scanner unit 104 is provided below the ADF 12. The scanner unit 104 reads a document fed by the ADF 12 or a document placed on the document table and generates image data. The scanner unit 104 is an example of a print document input unit. In addition, for example, a document created on the PC 200 as an external terminal can be accepted by this input unit and can be printed as image data.

The paper supply cassette 18 has plural cassettes for housing sheets of various sizes. The paper discharge unit 40 houses discharged sheets with an image formed thereon.

The printer unit 110 includes a laser exposure device or the like as an image forming unit, which will be described later. The printer unit 110 processes image data read by the scanner unit 104 or image data created on the PC 200 and forms an image on a sheet P. The sheet with the image formed thereon by the printer unit 110 is discharged to the paper discharge unit 40. The printer unit 110 is, for example, a four-drum tandem color laser printer. Photoconductive drums 22 of the image forming unit (see FIG. 3) are scanned with a laser beam emitted from a laser exposure device 19, and an electrostatic latent image is thus formed.

The laser exposure device 19 includes a polygon mirror 19*a*, an image forming lens system 19*b* and a mirror 19*c*, and scans the rotating photoconductive drums 22 in an axial direction, with a laser beam that is emitted from a semiconductor laser element and modulated by image data.

The printer unit 110 includes image forming units 20Y, 20M, 20C and 20K for each color of yellow (Y), magenta (M), cyan (C) and black (K). The image forming units 20Y, 20M, 20C and 20K are arranged under an intermediate transfer belt 21, from upstream to downstream along a direction of movement of the belt 21.

Figure 3:
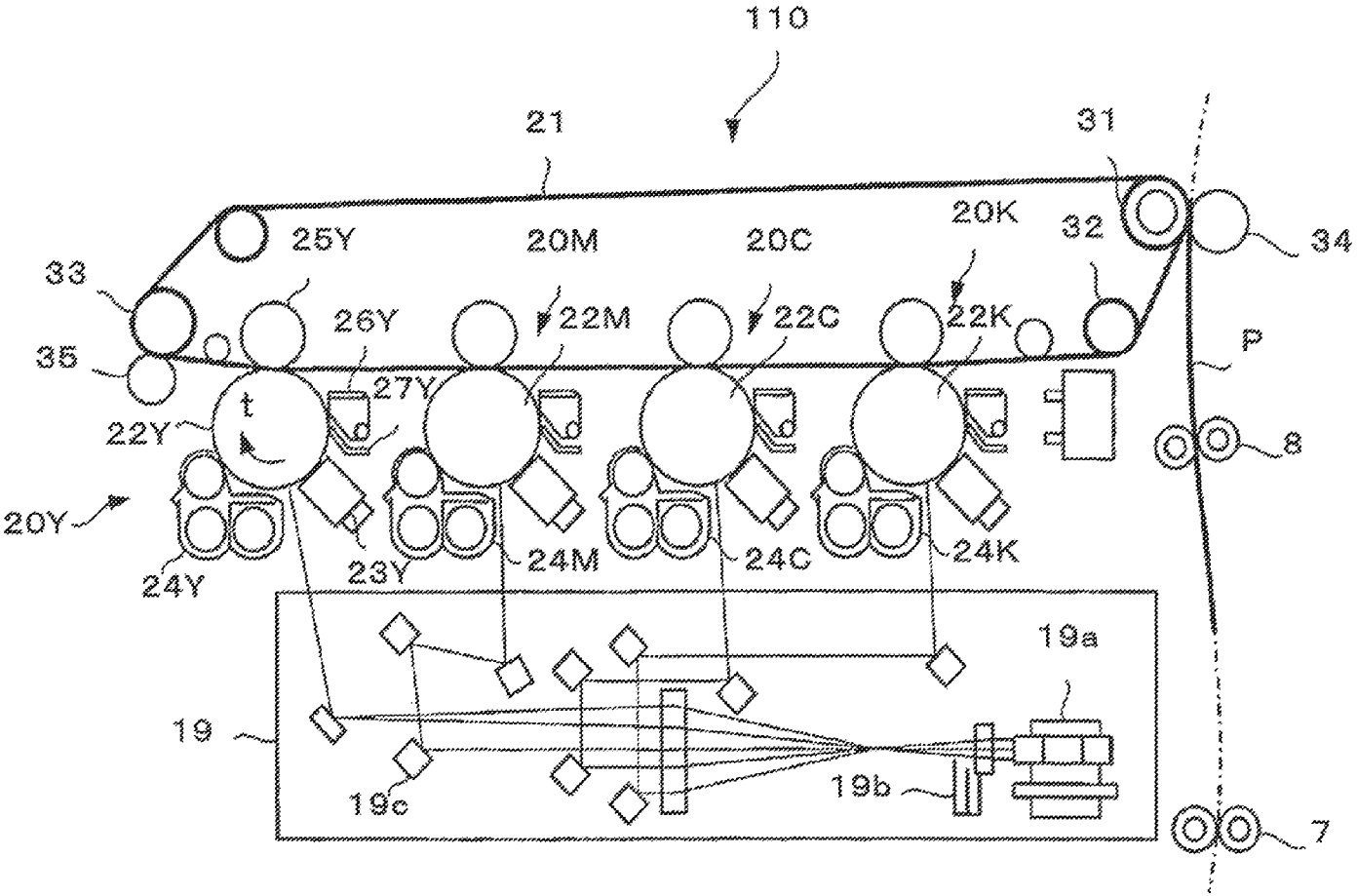
FIG. 3 is an enlarged view of a printer unit according to the first embodiment.

FIG. 3 is an enlarged view of the printer unit 110 including the image forming units 20Y, 20M, 20C and 20K. In the following description, the image forming unit 20Y will be described because the image forming units 20Y, 20M, 20C and 20K have the same configuration.

The image forming unit 20Y has a photoconductive drum 22Y that functions as an image carrier. Around the photoconductive drum 22Y, a charger 23Y, a developing unit 24Y, a primary transfer roller 25Y, a cleaner 26Y and a blade 27Y are arranged along a direction of rotation r. At an exposure position on the photoconductive drum 22Y, an electrostatic latent image is formed by a laser beam from the laser exposure device 19 that is modulated by image data corresponding to yellow.

The charger 23Y of the image forming unit 20Y uniformly charges the entire surface of the photoconductive drum 22Y. On this surface of the charged photoconductive drum, the electrostatic latent image is formed by the laser beam. The developing unit 24Y supplies a two-component developer containing a yellow toner and a carrier to the photoconductive drum 22Y, using a developing roller with a developing bias applied thereto. The electrostatic latent image on the photoconductive drum 22Y is developed by the supplied developer and thus becomes a toner image, which is a visible image. After a transfer process, described later, the cleaner 26Y removes the residual toner from the surface of the photoconductive drum 22Y, using the blade 27.

As shown in FIG. 2, a toner cartridge 2 which supplies a toner to each of the developing units 24Y, 24M, 24C and 24K is provided above the image forming units 20Y, 20M, 20C and 20K. In the toner cartridge 2, toner cartridges 2Y, 2M, 2C and 2K for each color of yellow (Y), magenta (M), cyan (C) and black (K) are next to each other. Of the toner cartridges of the respective colors, only the cartridge 2K for black (K) has a greater volume. This is because the amount of consumption of black toner is the largest in normal image forming.

In FIG. 2 and FIG. 3, the endless intermediate transfer belt 21 moves circularly and uses, for example, semiconducting polyimide in view of heat resistance and wear resistance. The intermediate transfer belt 21 is tensioned over a drive roller 31 and driven rollers 32 and 33 and faces and contacts the photoconductive drums 22Y, 22M, 22C and 22K. At a position on the intermediate transfer belt 21 facing the photoconductive drum 22Y, a primary transfer voltage is applied by the primary transfer roller 25Y and the toner image on the photoconductive drum 22Y is primary-transferred to the intermediate transfer belt 21.

A secondary transfer roller 34 is arranged opposite to the drive roller 31, over which the intermediate transfer belt is tensioned. When the sheet passes between the intermediate belt 21 and the secondary transfer roller 34, a secondary transfer voltage is applied to the sheet P by the secondary transfer roller 34, and the toner image on the intermediate transfer belt 21 is secondary-transferred to the sheet P. On the intermediate transfer belt 21 near the driven roller 33, a belt cleaner 35 for cleaning the residual toner that is not transferred to the sheet P in the secondary transfer process is provided.

As shown in FIG. 2, a pickup roller 36 for taking out the sheet P from the paper supply cassette 18, a feeding roller 37 and an aligning roller 38 are arranged in a feeding path extending from the paper supply cassette 18 to the secondary transfer roller 34. A fixing device 39 is arranged downstream of the secondary transfer roller 34.

The paper discharge unit 40 and a reverse feeding path 41 are provided downstream of the fixing device 39. The sheet P with the toner image fixed thereto by the fixing device 39 is discharged to the paper discharge unit 40. The reverse feeding path 41 is for reversing and guiding the sheet P toward the secondary transfer roller 34 and is used for performing double-side print.

The consumable supply 115 of the image forming apparatus 100 has the storage medium 116 (see FIG. 1). The consumable supply 115 is, for example, the toner housed in the toner cartridge 2, the developer housed in the developing unit 24, the photoconductive drum 22 as an image carrier, the transfer belt 21 and the transfer rollers 25 and 34 as transfer members, the blade 27, the belt cleaner 35, and the fixing device 39. The developer is a two-component developer containing a carrier and a toner. The storage medium 116 is provided on at least one of these consumable supplies 115. If the consumable supply 115 is the toner, the storage medium 116 is provided on the cartridge which houses the toner. If the consumable supply 115 is the developer, the storage medium 116 is provided on the cartridge which houses the developer or on the developing unit 24. For the consumable supplies 115 on which the storage medium 116 cannot be provided directly, such as the photoconductive drum 22, the transfer belt 21, the transfer rollers 25 and 34, the belt cleaner 35, and the fixing device 39, the storage medium 116 may be provided on a member or the like near these consumable supplies 115. If the consumable supply 115 is the blade 27, the storage medium 116 may be provided directly on the blade 27.

The storage medium 116 stores manufacture information proper to the consumable supply 115. The manufacture information proper to the consumable supply 115 is information including, for example, the serial number of the consumable supply, the serial number of the material of the consumable supply, manufacturing conditions at the time of manufacturing the consumable supply and the like.

Figure 4:
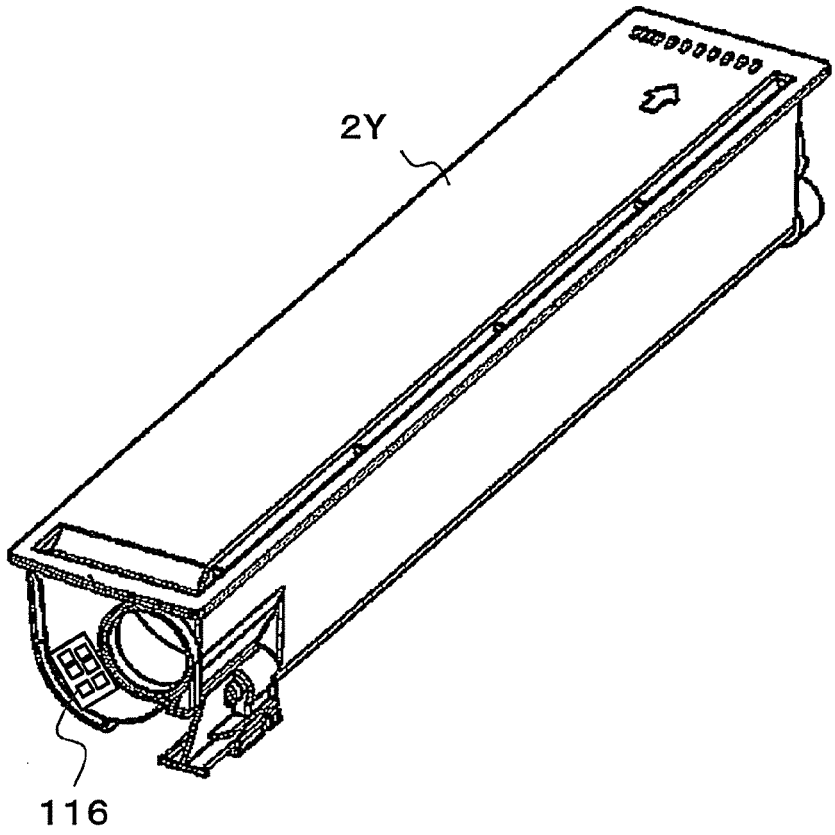
FIG. 4 shows a toner cartridge with a recording medium according to the first embodiment.

FIG. 4 shows the yellow toner cartridge 2Y with the storage medium 116 attached thereto, as an example of the consumable supply 115. Similarly to the yellow toner cartridge 2Y, the storage medium 116 is also attached to the magenta, cyan and black toner cartridges 2M, 2C and 2K. If the consumable supply 115 is the toner, the serial number of the material of the consumable supply, for example, silica and wax or the like, is recorded in the storage medium 116.

If a failure is found, for example, in a specific manufacture lot of a material after the shipment of the consumable supply 115, the consumable supply distributor or image forming apparatus distributor transmits failure information of the consumable supply 115 to the image forming apparatus 100 from the first server 301 via the communication interfaces 117 and 304. The failure information of the consumable supply 115 has a content, for example, that a failure may occur in the consumable supply manufactured on a specific manufacture line, with the serial number of the consumable supply and the serial number of the material of the consumable supply.

Figure 5:
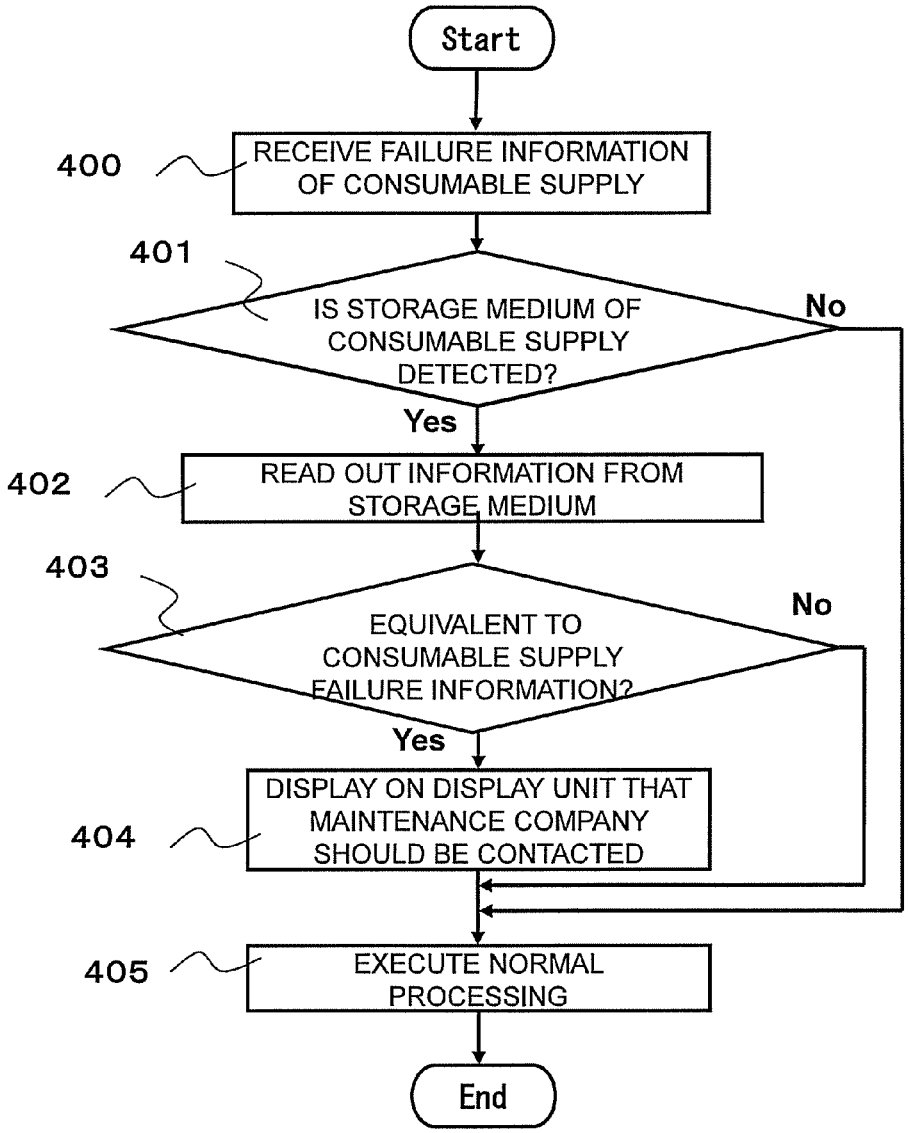
FIG. 5 is a flowchart showing notification of a failure of a consumable supply according to the first embodiment.

FIG. 5 is a flowchart showing notification of a failure of the consumable supply 115 in the image forming apparatus 100. In 400, the control unit 101 receives failure information of the consumable supply 115 from the first server 300, and in 401, determines whether the storage medium 116 of the consumable supply 115 is detected or not. If the storage medium 116 of the consumable supply 115 is not detected (No in 401), the control unit 101 executes normal processing (requested processing) in 405 and ends the operation.

If the storage medium 116 of the consumable supply 115 is detected (Yes in 401), the control unit 101 reads out information from the storage medium 116 in 402. The control unit 101 issues an instruction to the scanner CPU 105 of the scanner unit 104 so that the reading unit 112*b* (see FIG. 1) reads out the information from the storage medium 116.

In 403, the control unit 101 determines whether the read information from the storage medium 116 is equivalent to consumable supply failure information or not. If the read information from the storage medium 116 is not equivalent to consumable supply failure information (No in 403), the control unit 101 executes normal processing in 405 and ends the operation.

Figure 6:
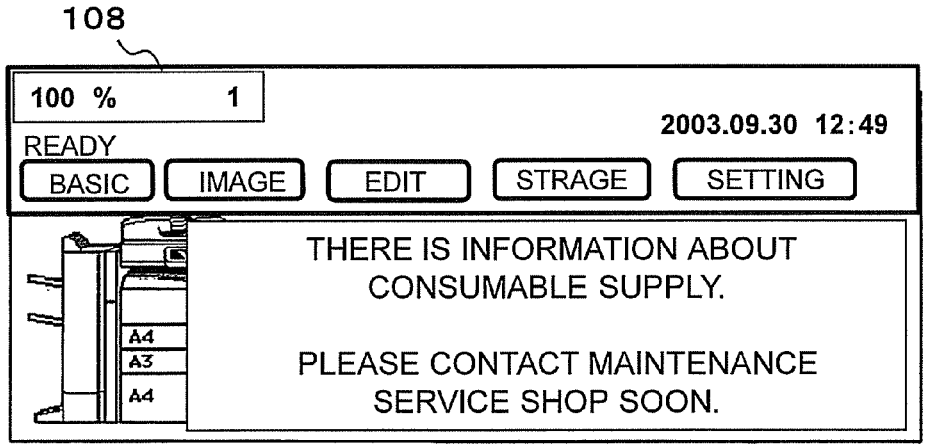
FIG. 6 shows an example of display by a display unit which notifies when there is a failure in a consumable supply according to the first embodiment.

If the read information from the storage medium 116 is equivalent to consumable supply failure information (Yes in 403), the control unit 101 displays on the display unit 108 that the maintenance company should be contacted, in 404, and executes normal processing in 405 and ends the operation. FIG. 6 shows an example of display on the display unit 108 notifying that there is a failure in the consumable supply 115. For example, the control unit 101 displays "There is information about the consumable supply. Please contact the maintenance service shop soon." on the display unit 108 and thus notifies the user of the failure of the consumable supply 115. The control unit 101 may also display a notification on the display unit 108 that prompts replacement of the failed consumable supply.

When the failure is resolved by replacing the failure-confirmed consumable supply 115 with a normal product or the like, the control unit 101 disappears the notification on the display unit 108. The control unit 101 controls the panel CPU 107 so that the display giving the notification of the failure of the consumable supply 115 temporarily disappears when the user inputs various settings such as the number of sheets for copy. Moreover, the notification of the failure of the consumable supply 115 is not limited to the display on the display unit 108 of the image forming apparatus 100. The control unit 101 may perform control so that the failure information is transmitted to the PC 200 and displayed on the display unit 202 of the PC 200. As the image forming apparatus 100 receives the failure information of the consumable supply 115 and the consumable supply 115 of the image forming apparatus 100 is determined as equivalent to a failed consumable supply, the control unit 101 may transmit the failure information of the consumable supply 115 directly to the maintenance company via the second server 301, without notifying the user of the failure information.

Even when there is a failure in the consumable supply 115, the consumable supply 115 can be made usable by changing setting conditions in the image forming apparatus 100. For example, when the consumable supply 115 is a toner and a reduction in image density due to a failure of the toner is conceivable, the failed consumable supply can be used by increasing the development contrast potential.

When a reduction in image density is conceivable, the first server 300 includes information about the setting of development contrast potential in the failure information and transmits the resulting failure information to the image forming apparatus 100. On receiving the failure information including the information about the setting of development contrast potential, the control unit 101 of the image forming apparatus 100 determines whether the consumable supply provided in the image forming apparatus 100 corresponds to the failure information or not. As the consumable supply provided in the image forming apparatus 100 is determined as corresponding to the failure information, the control unit 101 changes the development contrast potential to a desired setting. After changing the development contrast potential to the desired setting, the control unit 101 performs image forming processing and ends the operation. If the consumable supply provided in the image forming apparatus 100 is not determined as corresponding to the failure information, normal processing is executed and the operation ends.

With the image forming apparatus 100, the failure information notification system and the consumable supply failure information notification method as described above, one or both of the user and the maintenance company can be swiftly notified of information about a failure that is revealed after the shipment of consumable supplies such as toner, developer, image carrier, transfer belt, transfer roller, blade, belt cleaner, and fixing device. Moreover, a failed consumable supply can be quickly collected and can be quickly replaced with a normal consumable supply.

Second Embodiment

An image forming apparatus according to a second embodiment is an ink-jet image forming apparatus. If a failure is found after the shipment of a consumable supply, the control unit receives failure information and determines whether recorded information in the storage medium of the consumable supply is equivalent to the failure information or not. If the recorded information in the storage medium is equivalent to the failure information, the control unit notifies the user or the maintenance company. The same parts of the configuration as in the first embodiment are denoted by the same reference numerals.

Figure 7:
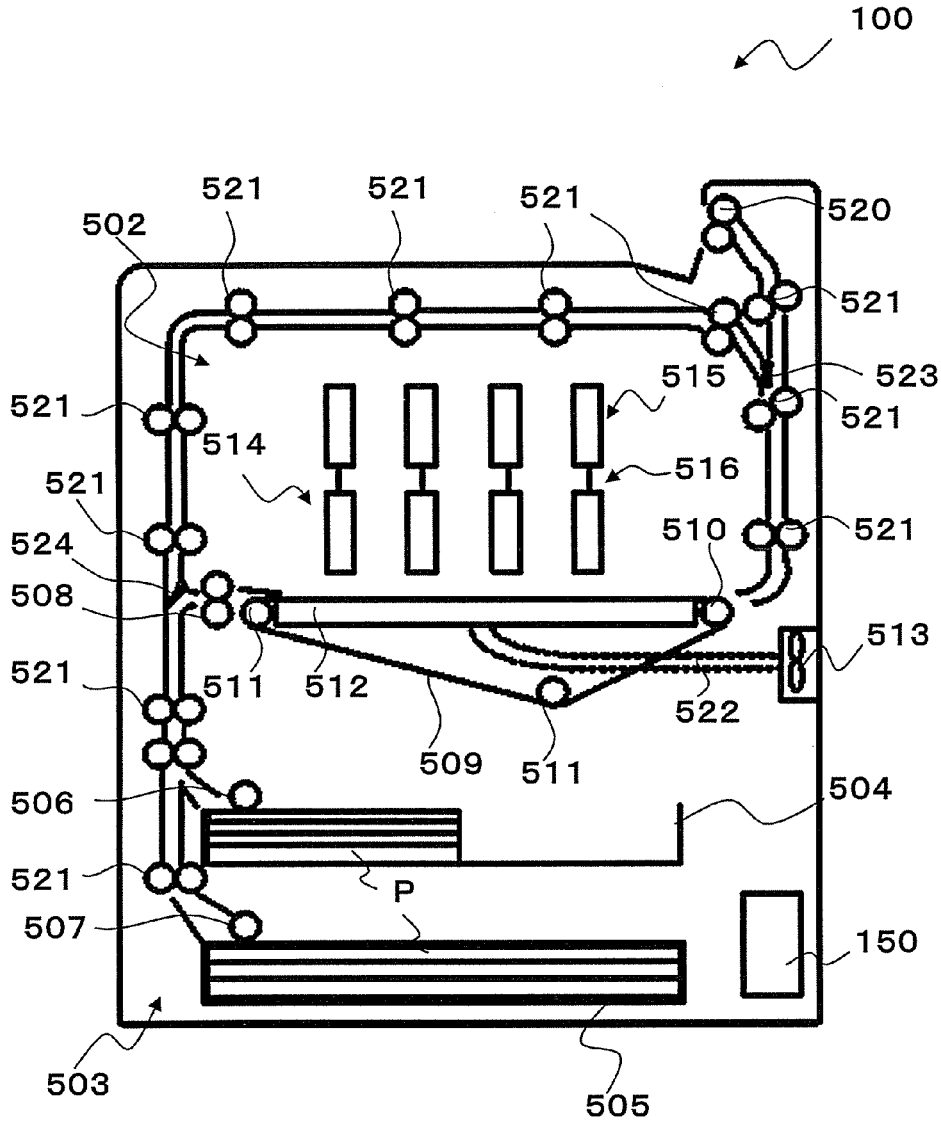
FIG. 7 is a view showing the configuration of an ink-jet image forming apparatus according to a second embodiment.

The failure notification system has the same configuration as the block diagram shown in the first embodiment. FIG. 7 shows the configuration of an ink-jet recording apparatus 100. The ink-jet recording apparatus 100 includes an image forming unit 502 and a storage unit 503.

The image forming unit 502, for example, ejects an aqueous ink and thus forms an image on the surface of a sheet P. The image forming unit 502 includes ink jet heads 514, ink cartridges 515 and tubes 516.

For the individual ink jet heads 514, a yellow (Y) ink cartridge, a magenta (M) ink cartridge, a cyan (C) ink cartridge and a black (K) ink cartridge which hold individual color inks are installed and connected thereto by tubes.

The individual color inks are yellow, magenta, cyan and black liquid inks or gel inks. Although a configuration for forming an image with the plural color inks of yellow, magenta, cyan and black is described above, without being limited to this, a configuration for forming an image with a single color ink may also be employed.

The storage unit 503 includes sheet cassettes 504 and 505 and a dehumidifier unit 150. The sheet cassettes 504 and 505 hold sheets P and can be drawn out forward in FIG. 7. The dehumidifier unit 150 is a dehumidifier, for example, silica gel. The dehumidifier unit 150 lowers the humidity in the storage unit 503 and dries the sheets P stored in the sheet cassettes 504 and 505. The dehumidifier unit 150 lowers the humidity in the storage unit 503 below the humidity in the image forming unit 502. It is desirable that the humidity in the storage unit 503 is lower than the humidity of air outside the ink-jet recording apparatus 100.

The ink-jet recording apparatus 100 includes paper supply rollers 506 and 507, plural feeding roller pairs 521, registration rollers 508, a feeding belt 509, a drive roller 510, driven rollers 511, a fan 513, a negative-pressure chamber 512, a paper discharge roller pair 520, feeding guides 523 and 524, and a duct 522.

The paper supply roller 506 takes out a sheet P from the sheet cassette 504, and the sheet P is fed by the feeding roller pair 521. The paper supply roller 507 takes out a sheet P from the sheet cassette 505, and the sheet P is fed by the feeding roller pair 521.

The feeding belt 509 is given a tensile force by the drive roller 510 and the two driven rollers 511. Innumerable small-diameter holes are opened at predetermined intervals on the surface of the feeding belt 509. Inside the feeding belt 509, a top plate of the negative-pressure chamber 512 connected to the fan 513 via the duct 522 is tightly in contact with the back side of the feeding belt 509 in order to suck the sheet P to the feeding belt 509. The negative-pressure chamber 512 has a top plate with a number of grooves and holes, and a hole for connecting the duct 522 for air discharge, and a hollow inside thereof is set to a negative pressure by suction with the fan 513. Moreover, the surface of the top plate of the negative-pressure chamber 512 contacts the surface of the feeding belt 509.

The suction force generated by the fan 513 causes the sheet P to be sucked to a feeding surface of the feeding belt 509 through the duct 522, the negative-pressure chamber 512 and the innumerable small-diameter holes on the feeding belt 509.

On a paper discharge side, the feeding roller pairs 521 and the paper discharge roller pair 520 are provided. The feeding guides 523 and 524 switch feeding routes of the sheet P by a solenoid.

The consumable supply 115 of the image forming apparatus 100 has the storage medium 116. The consumable supply 115 is, for example, the ink housed in the ink cartridges 515 and the feeding belt 509 as a feeding member. The storage medium 116 is attached to at least one of these consumable supplies 115. If the consumable supply is the ink, of course, the storage medium is provided on the ink cartridge. The storage medium 116 is a non-contact IC chip. Not limited to a non-contact IC chip, the storage medium 116 may also be a barcode, two-dimensional code or RFID tag. The storage medium 116 stores manufacture information proper to the consumable supply 115. The manufacture information proper to the consumable supply 115 is information including, for example, the serial number of the consumable supply, the serial number of the material of the consumable supply, manufacturing conditions at the time of manufacturing the consumable supply and the like.

The control unit 101 of the image forming apparatus 100 according to the second embodiment performs the same control as in the flowchart of FIG. 5 shown in the first embodiment. Therefore, a detailed explanation thereof will be omitted.

With the image forming apparatus, the failure information notification system and the consumable supply failure information notification method as described above, one or both of the user and the maintenance company can be swiftly notified of information about a failure that is revealed after the shipment of the ink and the feeding belt. Moreover, a failed consumable supply can be quickly collected and can be quickly replaced with a normal consumable supply.

Although some embodiments are described above, these embodiments are presented as examples and are not intended to limit the scope of the invention. These novel embodiments can be carried out in various other forms and various omissions, replacements and changes can be made without departing from the scope of the invention. These embodiments and modifications thereof are included in the scope of the invention and also included in the invention described in the accompanying claims and equivalents thereof.

What is claimed is:

1. An image forming apparatus comprising:

a storage medium stores manufacture information proper to a consumable supply;

a reading unit reads information in the storage medium;

a communication control unit receives failure information of the consumable supply;

a display unit displays information; and a control unit receives the failure information of the consumable supply by the communication control unit, which includes a content that a failure may occur in the consumable supply with the manufacture information proper to the consumable supply, then determines whether a consumable supply in use is equivalent to a failed consumable supply or not based on the manufacture information included in the failure information and the read manufacture information from the storage medium, and performs control to display the failure information on the display unit if the consumable supply is determined as equivalent to the failed consumable supply.

2. The apparatus of claim 1, wherein a notification prompting replacement of the consumable supply is issued via the display unit, based on the failure information.

3. The apparatus of claim 1, wherein a notification prompting to contact a maintenance company is issued via the display unit, based on the failure information.

4. The apparatus of claim 1, wherein the consumable supply is a toner.

5. The apparatus of claim 1, wherein the consumable supply is a liquid ink or gel ink.

6. The apparatus of claim 1, wherein the consumable supply is a developer.

7. The apparatus of claim 1, wherein the consumable supply is an image carrier.

8. The apparatus of claim 1, wherein the consumable supply is a transfer member.

9. The apparatus of claim 1, wherein there are plural consumable supplies and at least one consumable supply comprises a storage medium in which proper manufacture information is stored, and wherein the control unit further determines whether the recording medium of the consumable supply is present or absent when the failure information is received.

10. The apparatus of claim 1, wherein the failure information includes a setting of development contrast potential that enables resolution of the failure, and the control unit changes the setting of development contrast potential based on the failure information.

11. The apparatus of claim 1, wherein the manufacture information includes a serial number of the consumable supply.

12. The apparatus of claim 1, wherein the manufacture information includes a serial number of a material of the consumable supply.

13. The apparatus of claim 1, wherein the manufacture information includes manufacturing conditions at a time of manufacturing the consumable supply.

14. A consumable supply failure information notification method in a device using a consumable supply comprising a storage medium which stores manufacture information to the consumable supply, the method comprising:

receiving failure information of the consumable supply, which includes a content that a failure may occur in the consumable supply with the manufacture information proper to the consumable supply;

reading out the manufacture information from the storage medium;

determining whether a consumable supply in use is equivalent to a failed consumable supply or not according to the manufacture information included in the failure information and the manufacture information read out from the storage medium, based on the received failure information; and displaying the failure information when the consumable supply is determined as equivalent to the failed consumable supply.

15. The method of claim 14, wherein a notification prompting replacement of the consumable supply is issued, based on the failure information.

16. The method of claim 14, wherein a notification prompting to contact a maintenance company is issued, based on the failure information.

17. The method of claim 14, wherein there are plural consumable supplies and at least one consumable supply comprises a storage medium in which proper manufacture information is stored, and wherein whether the recording medium of the consumable supply is present or absent is determined when the failure information is received.

18. The method of claim 14, wherein the failure information includes a setting condition that enables resolution of the failure, and the setting condition is changed based on the failure information.

* * * * *